US005899026A

United States Patent [19]

Williams et al.

[11] Patent Number: 5,899,026

[45] Date of Patent: May 4, 1999

[54] MULTI-COMPONENT ELASTOMERIC MATERIALS FOR A BUILDING FLASHING SYSTEM

[76] Inventors: Mark F. Williams, 945 Tennis Ave., Maple Glen, Pa. 19002; William E. Donahue, 165 Wambold Rd., Harleysville, Pa. 19438

[21] Appl. No.: 08/939,412

[22] Filed: Sep. 29, 1997

[51] Int. Cl.[6] ..... E04D 1/36

[52] U.S. Cl. ..... 52/58; 52/63

[58] Field of Search ..... 52/58, 63

[56] References Cited

U.S. PATENT DOCUMENTS

| | | | |
|---|---|---|---|
| 4,462,190 | 7/1984 | Allen | 52/58 |
| 4,544,593 | 10/1985 | Borgert et al. | 52/58 X |
| 4,742,654 | 5/1988 | Cole | 52/58 X |
| 4,966,819 | 10/1990 | Schatz et al. | 52/58 X |
| 5,673,520 | 10/1997 | Yannucci et al. | 52/58 |

OTHER PUBLICATIONS

Pp. 1039–1040 of The Condensed Chemical Dictionary, Feb. 1991.

*Primary Examiner*—Creighton Smith

*Attorney, Agent, or Firm*—C. J. Husar

[57] ABSTRACT

The disclosure relates to building construction flashing materials that are presented in both liquid and solid form and is useful in new building construction as well as retrofit procedures. The liquid form is comprised of a silicone base which has been reformulated to improve its flowability and self-leveling qualities allowing it to be applied by brush, pump or spray apparatus. It can be used alone or it can serve as a complementary effective moisture barrier when used with the solid form of the elastomeric flashing materials. The solid form of the elastomeric flashing materials can be extruded sheet material, formed specialty accessories, and/or a readily formable metallic substrate material which has been completely coated with the reformulated liquid silicone, resulting in a highly bendable, formable and shape retaining flashing component. Both the liquid and solid forms serve as an effective moisture guard which can be used individually or together to protect a wide range of building constructions and keep building interiors dry.

33 Claims, 2 Drawing Sheets

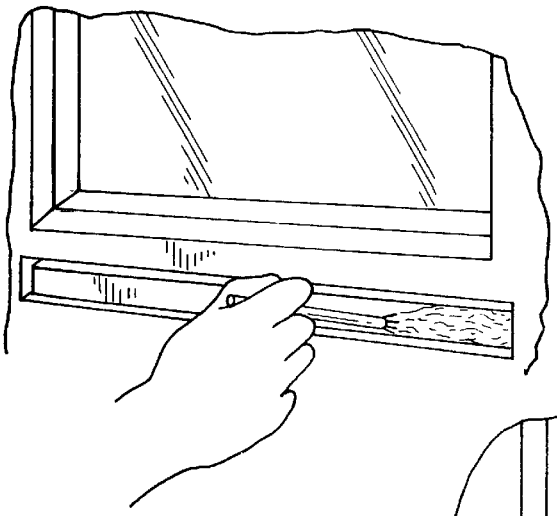
FIG. 1
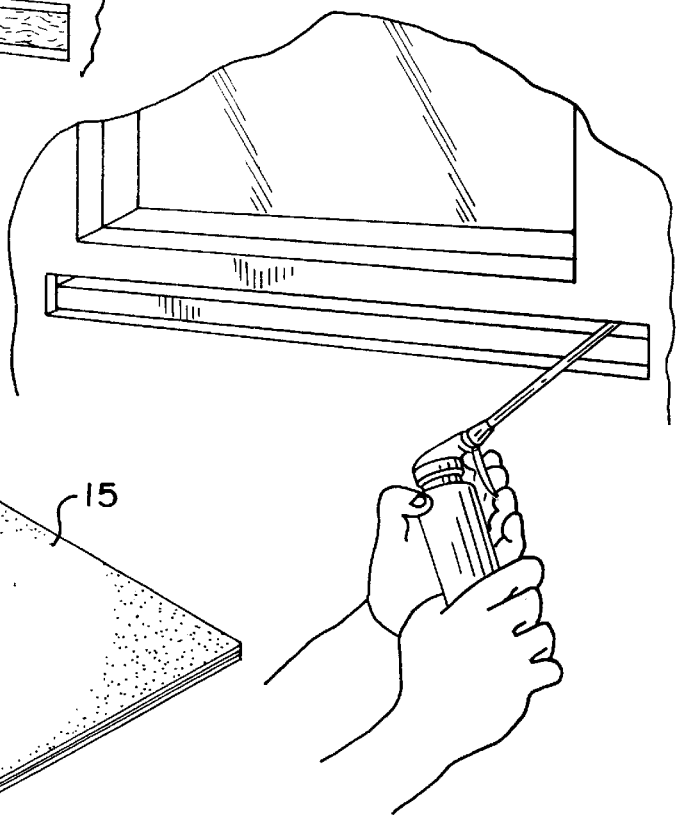
FIG. 2
FIG. 3
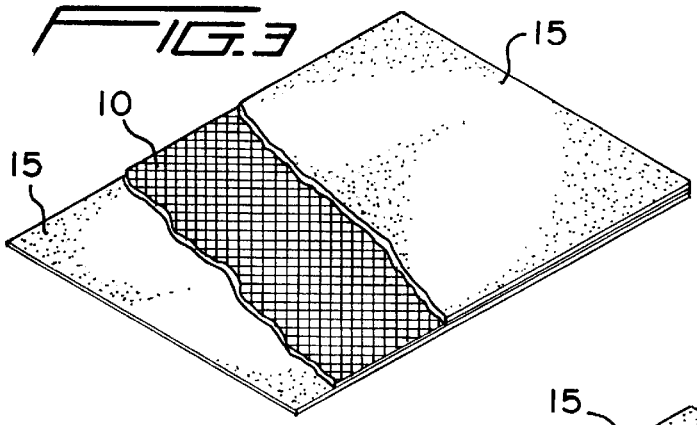
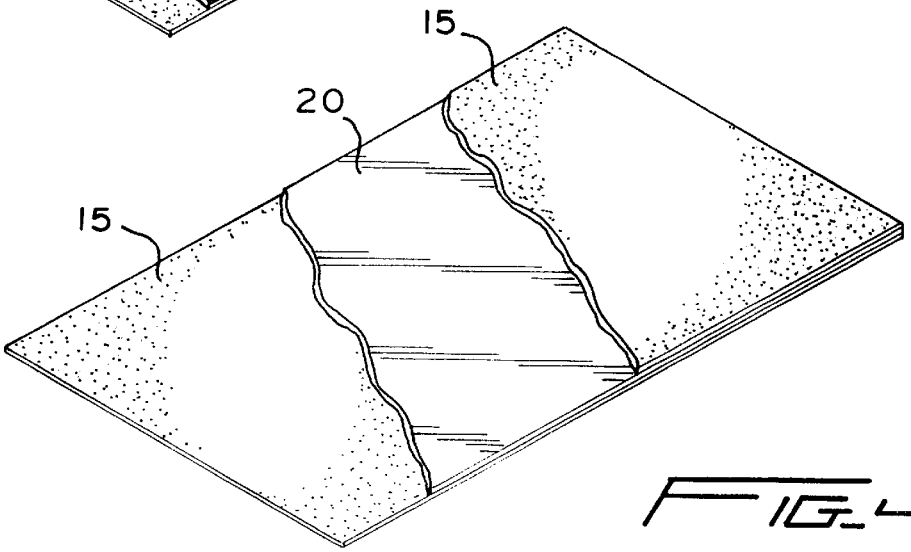
FIG. 4

FIG. 5
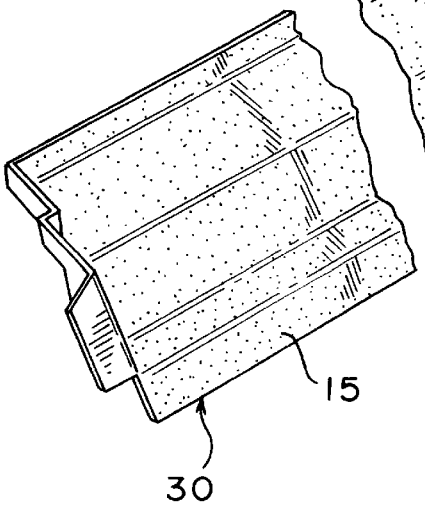
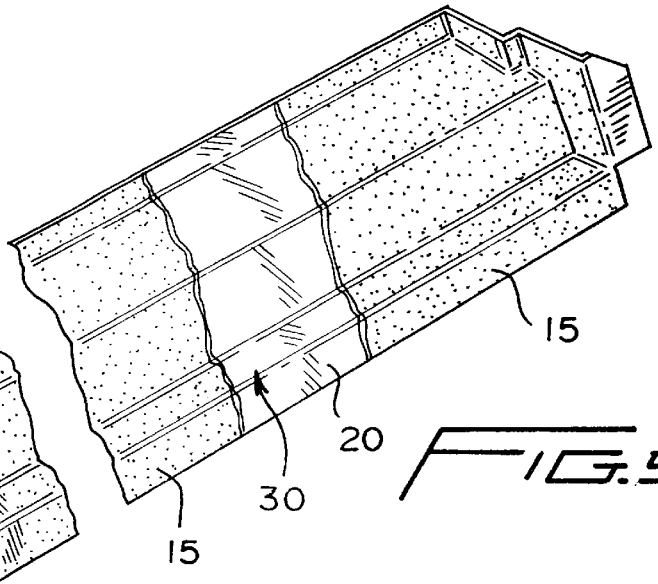
FIG. 5A
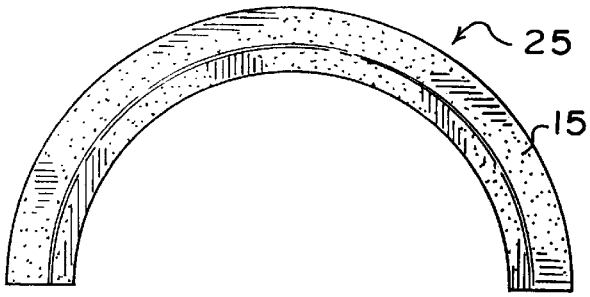
FIG. 6
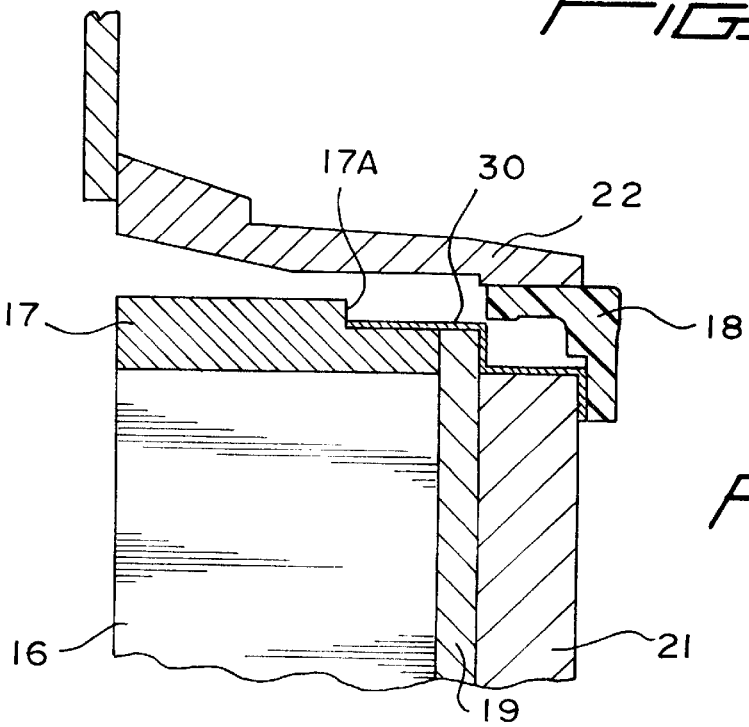
FIG. 7

MULTI-COMPONENT ELASTOMERIC MATERIALS FOR A BUILDING FLASHING SYSTEM

BACKGROUND OF THE INVENTION

1. Field of the Invention

The present invention relates to a system of elastomeric materials in liquid and solid forms used for the flashing of through-wall and roof penetrations and the like of new buildings under construction or existing buildings in need of repair. The purpose of this flashing system is to protect building assemblies and interiors from moisture penetration. The system is used as an effective moisture guard to protect a wide range of construction conditions and keep building interiors dry.

2. Description of the Prior Art

Materials installed between or over building components for the purpose of moisture protection are known as flashing. Wall and roof penetrations through the building enclosure typically include flashings between building components and at other locations to divert moisture that would otherwise accumulate within the building enclosure assembly. Through-wall conditions in need of flashing are typically varied in dimension and include inconsistencies due to the nature of the constructions. On new construction, flashing installation is required at these locations and like conditions; on existing construction, flashing is often required for remedial work at these same locations to prevent further material deterioration due to water intrusion or to provide compliance with changes in the building codes.

Prior art flashing systems has relied on semi-rigid sheet stock that has been formed and joined to other pieces with soldering, brazing or adhesive techniques. The flashing has been formed either on-site or in an off-site production facility. Fitting and installation typically occurs on-site. Flashing on existing construction generally involves the custom forming and fitting of flashing materials between building components such as below sills or sill-like features to divert water that would otherwise accumulate inside the wall assembly due to water intrusion through or around building components.

A major disadvantage of the semi-rigid sheet materials traditionally used for this purpose is their lack of in-situ formability and flexibility, properties needed to successfully follow and cover the irregularly shaped contours at locations in need of flashing. Cutting, bending and snippping of the presently available semi-rigid sheet stock has been required to physically form the prior art flashing materials to conform to the configuration of the particular area in need of flashing.

Another disadvantage of these prior art materials is their reliance on soldering, a brazing or adhesives to accomplish waterproof joints where the material has been overlapped or joined. Soldered or brazed joints are particularly rigid and prone to breaking or cracking under extreme weather conditions or when pressure is exerted during the placement and fitting of metal flashing. This can result in splits, holes or voids at flashing joinings that allow water migration and consequently defeating the overall purpose of the flashing.

The prior art is extremely limited in its capacity to fit unique individual conditions. This has proven especially problematic on retrofit installations characterized by irregular, atypical conditions. A wide range of conditions and related dimensions can be present with irregular and unknown contours, making proper flashing fit on retrofit installations particularly cumbersome, requiring laborious, time-consuming and near perfection of custom-fitting to individual conditions. Off-site production of the flashing elements has also been associated with fitting problems. Flashing manufactured in accordance with standard, project-specific and expected dimensions and tolerances assume that in general, conditions at the site are both regular and uniform. Unfortunately, all too often, standardized flashings dimensioned and formed off-site do not fit when attempts are made to install them at the site due to construction variances and the like. Consequently, these "standardized" flashings also present problems of difficulty in fitting to particular conditions. Because there has been no easy way to modify these flashings in the field to achieve proper fit, flashings have often been omitted or poorly placed so that they do not perform their intended purpose, allowing water bypass and subsequent moisture damage to construction materials and building interiors.

Due to these limitations inherent in the prior art, the level of moisture protection provided by flashing has been highly dependent on the installer's skill and patience, for both new and existing construction. Thus, the achievement of satisfactory flashing performance has not been accomplished on a consistent basis. This is particularly true on retrofit projects typically involving non-standard conditions which require custom fit by the installers at each flashing location.

SUMMARY OF THE INVENTION

The present invention overcomes the shortcomings of the known prior art devices by providing an integrated system of elastomeric materials in liquid and solid forms that are compatible with most known, common building materials and capable of fitting the wide range of construction conditions associated with flashing locations. Materials such as silicones, urethanes, polyurethanes and other elastomers may be used for these systems. In one preferred embodiment, it has been found that a low modulus neutral cure silicone sealant can be reformulated to produce a low viscosity material as the base product for a multi-component system of elastomeric products in solid (homogenous and composite) and liquid (unreinforced and internally reinforced) forms. This series of elastomeric based products/components can be utilized singly or collectively to form a flashing system which is a highly effective moisture guard for retrofit or new construction at penetrations or terminations of building components. The components comprising the system can be used individually or collectively, in various combinations of components, depending on the requirements of the construction conditions present.

The system accomplishes fast and complete waterproofing of virtually all through-wall openings, regardless of the potential dimensional variances present. Due to its inclusion of both solid and liquid components, the system has the ability to accommodate almost any pre-existing conditions. It realizes a significant reduction in the amount of time and skill needed to obtain moisture-tight conditions at flashing locations, thus providing significant cost reductions while simultaneously providing a more effective, neater sealing of the areas.

The system comprises liquid and solid materials. Two different solid components are provided. First, a homogenous formulation of the elastomeric material can be extruded without or with articulations to aid placement over angled planes to form a thin (approximately 1–2 mm thick) sheet stock that is flexible, cuttable, and highly formable; or the elastomeric material can be formed by molding or extruding in specific shapes for specialty conditions.

Second, it is well known in the construction industry that elastomeric products bond tenaciously with clean metal. This elastomeric may be used to coat one or both sides of light gauge metal, such as foil, aluminum, stainless steel, steel, copper, or other metals creating a flashing material that not only is easily cut, folded, bent, crimped, and formed to conform to the necessary shape, but also retains its shape once formed. This composite sheeting is especially valuable at locations where the semi-rigid sheeting needs to be sealed against itself, the extruded sheet material, the formed specialty pieces or other system components and the existing construction with a liquid form of the system.

The liquid component, using the same specialized elastomeric formulation, is available in an unreinforced form and also in an internally reinforced form, (incorporating fibrous materials for reinforcement). Due to the low viscosity of the elastomeric formulation, the two liquid forms can be applied with a brush, pump, or spray apparatus, and most importantly, flow easily with self-leveling properties while providing sufficient coverage to successfully waterproof vertical surfaces. In one preferred embodiment, the elastomeric liquid is a neutral cure silicone. Once the silicone has completely cured (the time frame for this is dependent on temperature and humidity), there are no harmful gasses or vapors emitted from the material. Because the neutral cure chemistry has a pH near 7, and this particular formulation is nearly solvent free, the silicone is compatible with almost all common building materials. The chemistry of the new liquid flashing material is initially similar to the base materials for commercially available silicone sealant. However, due to the unique additional ingredients and the sequence of combining these ingredients the improved liquid material has many special properties, such as self leveling, self sealing, auto bonding, fast cure, tear resistant, mildew resistant, and cold weather flexibility, to name a few. The addition of various novel ingredients and the sequence for combining these ingredients provides the self-leveling and Theological properties for waterproofing vertical and horizontal surfaces. These low viscosity, self-leveling components proved a highly effective and quick means for obtaining closure and protection, whether related to solid system component configurations such as end dams or configurations present in the adjacent construction. The liquid forms are extremely useful in addressing voids or holes in the underlying construction, or within and between the flashing materials themselves, due to the flowing, self-leveling properties of the specially formulated silicone chemistry. Unlike prior art flashing systems that were highly dependent on the skill and attention of the installer to detect and seal such imperfections in the flashing assembly, the liquid silicone flows and forms easily, filling holes and crevices when applied to the surfaces.

It is well-known that silicone is generally impervious to moisture pass through. Nevertheless, it is a breathable, vapor permeable material, where water vapor can potentially pass-through due to the material's unique permeability. The metal layer of this composite system component, while protected on one or both sides by a highly moisture resistant silicone coating, is also a mechanical barrier to water vapor which may be necessary for certain project conditions. A mildewicide has also been added to the formulation to suppress the growth of micro-organisms within the flashing system in the event that standing water occurs.

In addition to the liquid silicone previously described, the liquid and solid components of the system also may be achieved with urethanes, polyurethanes or other elastomeric materials. Because both the liquid and solid forms share the same chemistry, there is material compatibility and adhesion between system components. This material compatibility and adhesion also extends to most common construction materials typically related to flashing conditions such as wood, gypsum, masonry, and other common building construction materials.

The flexibility inherent with such elastomeric materials for the flashing system, in combination with its intra-component compatibility, allows coverage of a wide range of potential conditions and is particularly useful for remedial work that requires flashing. For example, the liquid elastomeric material can be applied to the sill area, followed by placement of the extruded or composite sheet material flashing easily fitted to conform to the prevailing conditions. The end portions of the flashing assembly can then be sealed with the liquid form of the elastomeric material, delivered by means of a spray gun, pump, or paint brush so that the full flashing system prevents the passage of water. If required, formed shapes of the same elastomeric material for specialty conditions may be molded or extruded and incorporated in the flashing system. The result is accomplished with considerably less amount of time and skill with respect to forming, fitting, joining and sealing.

OBJECTS OF THE INVENTION

An object of the invention is to provide a novel flashing system for new and retrofit building constructions.

A further object of the invention is to provide a flashing system which is available in both liquid and solid forms.

Another object of the invention is to provide a flashing system wherein the solid forms are readily shaped and formed to accommodate all flashing requirements.

Yet another object of the invention is to provide a flashing system which can be installed with less skill and time requirements than presently available systems.

A still further object of the invention is to provide a flashing system wherein the materials used are compatible with most commonly used construction materials.

Another object of the invention is to provide a multi-component elastomeric liquid flashing form which is smooth-flowing and self-leveling to readily and completely fill voids in the flashing area.

Yet another object of the invention is to provide a flashing material which contains a mildewicide for suppressing the growth of microorganisms.

Another object of the invention is to provide improved elements and arrangements thereof in a product for the purposes described which is inexpensive, dependable and fully effective in accomplishing its intended purposes.

These and other objects of the invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 1 is an illustration of the novel liquid elastomeric material being manually applied by brush.

FIG. 2 is an illustration of the liquid elastomeric material applied by a hand pump.

FIG. 3 is an illustration of a sheet of elastomeric material flashing in solid form having a substrate therein.

FIG. 4 is an illustration of another form of the elastomeric material flashing in solid form having a substrate therein.

FIG. 5 is an illustration of the solid form of elastomeric sheet material without a substrate which has been formed by molding or extruding the elastomeric material into a specialty profile.

FIG. 5A is an illustration of the elastomeric material coated flashing including a substrate which has been formed into a specialty profile for insertion beneath a window sill.

FIG. 6 is an illustration of the solid form of flashing formed into a radius drip cap for flashing an arcuate window.

FIG. 7 is a sectional view taken taken through a building structure showing the liquid and solid forms of flashing used for retrofit purposes below a window sill.

DETAILED DESCRIPTION OF THE PREFERRED EMBODIMENTS

Referring now to FIG. 1, there is an illustration of the liquid form of elastomer material flashing in the process of being applied by brush. As shown, the liquid elastomeric material 15 readily adheres and flows into the crevices and upon curing, provides a solid and effective closure. The approximate thickness of this coating layer is 1–2 mm.

As indicated earlier, one preferred embodiment of the elastomeric material is liquid silicone, a specially formulated product wherein commercially available silicone sealant chemistry has been reformulated. The manner in which it has been reformulated is as follows. A commercially available neutral cure silicone was modified by the addition of a number of novel ingredients and also by the method of production. Specific ingredients include very low molecular weight reactive dimethyl siloxanes, multifunctional silane adhesion additives, a unique tin catalyst and mildewicide. The production technique involves the compounding sequence. The result is a very low viscosity, self-leveling silicone that is nearly free of solvent. It cures rapidly under a wide range of environmental conditions (including dampness) to a tough, extensible and tear resistant elastomer. Owing to its neutral chemistry and superior adhesion, it is compatible with practically any construction substrate. Other attributes include good cold temperature flexibility, autobonding capability and the ability to suppress mildew growth.

A second embodiment of the liquid form has been further modified by the addition of fibrous materials such as Kevlar aramid fiber. The addition of this fiber material serves to internally reinforce the reformulated liquid silicone, the fiber particle size being such that it does not interfere with the flowability and self-leveling properties of the liquid silicone and is intended for use primarily in its liquid form, i.e. without any metallic substrate material. These forms of specialized liquid silicone can be applied with a brush, pump, or spray apparatus and exhibit the same smooth flowing and self-leveling properties mentioned above and serve to provide excellent coverage and sealing to waterproof all vertical and horizontal surfaces.

FIG. 2 is an illustration of the liquid elastomeric material 15 in the process of being applied manually by a hand pump 23. As shown, the liquid elastomeric material is being applied to internal surfaces of the existing construction. The liquid elastomeric material treatment is the innermost line of defense against penetration of moisture into the wall framing and sheething with the outermost flashing material, that is the extruded, formed or composite metallic flashing material to be subsequently added, as explained hereinafter.

FIG. 3 is an illustration of one of the solid forms of the novel elastomeric material. As shown, a sheet of reinforcing fabric such as commercially available screening (copper, aluminum, steel or fiberglass) substrate material 10 has been coated with a coating of the specially formulated elastomeric material 15. The coating is in the range of one-two mm. thick. However, its thickness is such that after the elastomeric material 15 has cured, the new flashing material can readily by shaped and formed without cracking or peeling of the specialized elastomeric material 15 from the metallic substrate support 20 and once the shaping is done, the flashing material will retain the shape formed. It is also readily cut with a snipper or scissors, and sealed with the liquid elastomeric material 15.

FIG. 4 is an illustration of another form of the novel elastomeric material flashing in sheet form. In this embodiment, a soft flexible metallic substrate sheet 20, such as light gauge (in the approximate range of 24 to 36 gauge) foil, aluminum, stainless steel, copper, or other suitable metals, has been coated on both sides with the specially formulated silicone 15. Alternatively, the metallic substrate may be coated on one side only.

FIG. 5 is an illustration of the solid form of the elastomeric material flashing 15 without any substrate 20 therein which has a linear extruded piece combined with molded specialty termination pieces to form end dams for flashing below a window sill 30.

FIG. 5A is an illustration of the solid form of elastomeric material flashing which has been shaped in-situ into a particular window sill flashing member 30. As shown, the flexibility and bendability characteristics of the elastomeric flashing material 15 and foil substrate 20 has permitted it to be shaped by hand to custom fit the needs of the particular job at hand. The solid forms of both FIG. 5 and FIG. 5A can be shaped by hand in-situ or preformed in commonly used sizes, and combined with the liquid elastomeric material thus eliminating the need for near perfection in hand shaping.

FIG. 6 is another illustration of the solid form of elastomeric material flashing 15, which has been hand formed into a radius drip cap 25 for an arcuate window. Again, the flexibilty and bendability of the elastomeric flashing 15 permits bending and hand forming of the sheet elastomeric material into most desired shapes. Once it is formed into a particular shape, it will retain that shape and yet allow for further bending if necessary or required to present a customized fit for the particular job.

FIG. 7 is a sectional view taken through a building structure showing the window sill 22 with a cut-out portion therebeneath. As illustrated, a vertical stud member 16 is capped with a horizontal top cross member 17 which has a cut-out portion 17A to receive the liquid silicone material and specially shaped solid silicone flashing member 30 which is shown in place. Also sheathing member 19 and outer member 21, which is the outermost member and is exposed to the building exterior, are shown. The liquid form of FIGS. 1 and 2 have been applied. Solid flashing member 30 is in place and exterior trim member 18 is about to be secured in position for completing the retrofit flashing beneath window sill 22.

Although the illustrations and discussions to this point have been directed to the use of the liquid silicone and the solid forms of silicone sheet flashing as a means of effective sealing against moisture intrusion with regard to window sills (both new and retrofit constructions), urethane, polyurethane and other elastomeric materials would be equally effective. It has been found that the uses of these forms of flashing materials is almost limitless. For example, it finds effective use above and around all windows, doors, thresholds, vents, roofing valleys, ridges and any other place where there is a possibility of moisture leakage whether it be from rain, snow or the like, accumulating in these areas. The elastomeric attributes of bondability with most construction materials such as wood, brick, expanded polystyrene insulation, masonry and its ability to be bent and shaped into a customized fit add to its overall effectiveness and durability.

While the invention has been described in its preferred embodiments, it is to be understood that the words which have been used are words of description rather than limitation and the present invention is not limited to the embodiments described above, but encompasses any and all embodiments within the scope of the following claims.

Having thus described our invention, we claim:

1. A building flashing system for preventing the intrusion of moisture into the interior of buildings comprising:

a multi-component elastomeric liquid flashing material including a base component and additional components having smooth flowing and self-leveling properties for providing a primary barrier to the penetration of moisture;

a flexible solid form of said multi-component elastomeric material for providing a supplementary barrier to the penetration of moisture; and a formed specialty accessory to provide closure at terminal locations; whereby upon curing of said multi-component elastomeric liquid material, said primary barrier, said supplementary barrier and said formed specialty accessory cooperate to provide a waterproofing flashing system to prevent the penetration of moisture and is utilized with less skill and time than previously used flashing materials in forming varied shapes of flashing.

2. A building flashing system as defined in claim 1 wherein said flexible solid form of said multi-component elastomeric material includes a substrate material that is coated with said multi-component elastomeric material on at least one side thereof.

3. A building flashing system as defined in claim 1 wherein said flexible solid form of said multi-component elastomeric material is extruded into sheet form, with or without articulations.

4. A building flashing system as defined in claim 2 wherein said multi-component elastomeric material is extruded into sheet form, with or without articulations.

5. A building flashing system as defined in claim 2 wherein said substrate is light gauge copper sheeting.

6. A building flashing system as defined in claim 2 wherein said substrate is light gauge steel sheeting.

7. A building flashing system as defined in claim 2 wherein said substrate is light gauge stainless steel sheeting.

8. A building flashing system as defined in claim 2 wherein said substrate is reinforcing fiberglass fabric material.

9. A building flashing system as defined in claim 3 wherein said liquid multi-component elastomeric material includes fibrous material for internal reinforcement.

10. A building flashing system as defined in claim 1 wherein said base component of said multi-component elastomeric liquid material is silicone and said additional components of said multi-component liquid flashing material includes very low molecular weight reactive dimethyl siloxanes, multi-functional silane adhesion additives and a unique tin catalyst to produce a very low viscosity, self-leveling silicone that is substantially free of solvents which cures rapidly under a wide range of environmental conditions resulting in a tough, extensible and tear resistant elastomer.

11. A building flashing system as defined in claim 10 wherein said multi-component elastomeric liquid includes a further component which is mildewicide to suppress the growth of microorganisms.

12. A building flashing system as defined in claim 1 wherein the base component of said multi-component elastomeric liquid flashing material is urethane.

13. A building flashing material as defined in claim 1 wherein the base component of said multi-component elastomeric liquid flashing material is polyurethane.

14. A multi-component elastomeric liquid flashing system for preventing the intrusion of moisture into the interior of buildings comprising:

an elastomeric sealant in liquid form as the base component;

additional components added to said base component to improve its self-leveling characteristics and rheological properties for its intended usage;

and a further component to suppress the growth of microorganisms in the presence of moisture whereby said components cooperate to provide an elastomeric barrier which effectively bonds to most building construction materials and upon curing effectively fills all voids in an area to be flashed to prevent moisture pass through in these areas.

15. A multi-component liquid elastomeric flashing system as defined in claim 14 wherein a reinforcing component is added to internally reinforce said multi-component liquid flashing system.

16. A multi-component liquid elastomeric flashing system as defined in claim 15 wherein said reinforcing component is a fibrous material.

17. A multi-component liquid elastomeric flashing system as defined in claim 16 wherein said fibrous material is Kevlar aramid fiber.

18. A multi-component liquid elastomeric flashing system as defined in claim 14 wherein said base component is silicone.

19. A multi-component liquid elastomeric flashing system as defined in claim 14 wherein said base component is urethane.

20. A multi-component liquid elastomeric flashing system as defined in claim 14 wherein said base component is polyurethane.

21. A multi-component liquid elastomeric flashing system as defined in claim 14 wherein said base component is any suitable elastomeric material.

22. A combination of building flashing materials for preventing the intrusion of moisture into the interior of buildings comprising:

a multi-component elastomeric liquid flashing material including a base component and additional components for smooth flowability and self-leveling characteristics;

a multi-component extruded sheet of solid flashing material with or without articulations, including a substrate which has been coated on at least one side with said multi-component elastomeric liquid flashing material to form a flexible, bendable flashing member; and a specialty accessory formed with the same elastomeric material to provide closure at terminal locations; whereby upon application and curing of said multi-component elastomeric liquid flashing material followed by insertion of said solid flashing member and said formed specialty accessory, a complete waterproofing of a desired area is accomplished.

23. A combination of building flashing materials as defined in claim 22 wherein said multi-component elastomeric liquid flashing material includes silicone as its base component to improve its flowability and self-leveling properties.

24. A combination of building flashing materials as defined in claim 22 wherein said multi-component elastomeric liquid flashing material includes urethane as its base component with additional components to improve its flowability and self-leveling properties.

25. A combination of building flashing materials as defined in claim 22 wherein said multi-component elastomeric liquid flashing material includes polyurethane as its base component with additional components to improve its flowability and self-leveling properties.

26. A combination of building flashing materials as defined in claim 22 wherein said substrate is light gauge aluminum sheeting.

27. A combination of building flashing materials as defined in claim 22 wherein said substrate is a fiberglass reinforcing fabric material.

28. A combination of building flashing materials as defined in claim 22 wherein said substrate is light gauge copper sheeting.

29. A combination of building flashing materials as defined in claim 22 wherein said substrate is light gauge stainless steel sheeting.

30. A combination of building flashing materials for preventing the intrusion of moisture into the interior of buildings comprising:

a multi-component elastomeric liquid flashing material including a base component and additional components for flowability and self-leveling characteristics;

a multi-component elastomeric extruded sheet, with or without articulations, of solid flashing material formed into a flexible, bendable flashing member; and a formed specialty accessory to provide closure at termination locations; whereby upon application and curing of said multi-component elastomeric liquid flashing material followed by insertion of said extruded solid flashing member and said formed specialty accessory, a complete waterproofing of a desired area is accomplished.

31. A combination of building flashing materials as defined in claim 30 wherein said multi-component elastomeric liquid flashing material includes silicone as its base component to improve its flowability and self-leveling properties.

32. A combination of building flashing materials as defined in claim 30 wherein said multi-component elastomeric liquid flashing material includes urethane as its base component with additional components to improve its flowability and self-leveling properties.

33. A combination of building flashing materials as defined in claim 30 wherein said multi-component elastomeric liquid flashing material includes polyurethane as its base component with additional components to improve its flowability and self-leveling properties.

* * * * *

UNITED STATES PATENT AND TRADEMARK OFFICE

CERTIFICATE OF CORRECTION

PATENT NO. : 5,899,026

DATED : May 4, 1999

INVENTOR(S) : Williams Et al

It is certified that error appears in the above-indentified patent and that said Letters Patent is hereby corrected as shown below:

Column 3, line 37, --- Theological --- should read, --- rheological ---.

Signed and Sealed this

Thirty-first Day of August, 1999

*Attest:*

Q. TODD DICKINSON

*Attesting Officer*

*Acting Commissioner of Patents and Trademarks*